United States Patent [19]

Ishigami

[11] Patent Number: 4,572,139

[45] Date of Patent: Feb. 25, 1986

[54] FUEL SUPPLY CONTROL SYSTEM FOR AN INTERNAL COMBUSTION ENGINE

[75] Inventor: Kazuhiro Ishigami, Yokohama, Japan

[73] Assignee: Nissan Motor Company, Limited, Yokohama, Japan

[21] Appl. No.: 640,861

[22] Filed: Aug. 15, 1984

[30] Foreign Application Priority Data

Aug. 29, 1983 [JP] Japan ..... 58-157665

[51] Int. Cl.[4] ..... F02B 29/00; F02M 51/00

[52] U.S. Cl. ..... 123/478; 123/559; 123/585

[58] Field of Search ..... 123/478, 559, 585, 480, 123/493, 565

[56] References Cited

U.S. PATENT DOCUMENTS

| | | | |
|---|---|---|---|
| 4,445,336 | 5/1984 | Inoue | 123/559 |
| 4,450,814 | 5/1984 | Sawamoto et al. | 123/478 |
| 4,470,394 | 9/1984 | Tadokoro et al. | 123/559 |
| 4,471,742 | 9/1984 | Kishi | 123/478 |
| 4,473,052 | 9/1984 | Kamiyama et al. | 123/478 |
| 4,492,203 | 1/1985 | Yutaka | 123/478 |
| 4,498,443 | 2/1985 | Hasegawa et al. | 123/478 |
| 4,512,315 | 4/1985 | Tomisawa | 123/478 |
| 4,523,570 | 1/1985 | Suzuki et al. | 123/478 |

*Primary Examiner*—Raymond A. Nelli

*Attorney, Agent, or Firm*—Schwartz, Jeffery, Schwaab, Mack, Blumenthal & Evans

[57] ABSTRACT

An internal combustion engine has a combustion chamber and an air passage leading to the combustion chamber for conducting air to the combustion chamber. A throttle valve is disposed in the air passage for adjusting the rate of air flow into the combustion chamber. A compressor is disposed in the air passage at a point upstream of the throttle valve for compressing the air. A flow meter is disposed in the air passage at a point upstream of the compressor for sensing the rate of air flow through the air passage. Fuel is injected into the air passage at a point downstream of the throttle valve. The rate of fuel injection normally has a preset relationship with the sensed air flow rate. When the throttle valve is closed, the fuel injection rate is limited to no more than a predetermined level regardless of the preset relationship between the fuel injection rate and the sensed air flow rate. In the case of periodic fuel injection at a frequency proportional to engine speed, the amount of fuel injected during each fuel injection stroke may be limited to a predetermined level when the throttle valve is closed.

6 Claims, 8 Drawing Figures

FUEL SUPPLY CONTROL SYSTEM FOR AN INTERNAL COMBUSTION ENGINE

BACKGROUND OF THE INVENTION

1. Field of the Invention

This invention relates to a fuel supply control system for an internal combustion engine.

2. Description of the Prior Art

Some internal combustion engines are equipped with fuel injection valves via which fuel is injected into an air intake passage at a point downstream of a throttle valve. In most of these engines, and air flow meter senses the rate of air flow through the intake passage at a point upstream of the throttle valve. The rate of fuel injection is controlled basically in proportion to the sensed air flow rate to maintain a desired air-to-fuel ratio of the mixture entering the engine.

In the case where these engines have a turbocharger to boost the engine power output, the compressor of the turbocharger is generally disposed in the intake passage at a point upstream of the throttle valve but downstream of the air flow meter. In this case, when the throttle valve is rapidly closed to quickly reduce the engine speed from its cruising speed, the air-fuel mixture goes excessively rich as a result of the following considerations. Immediately after the closing of the throttle valve, the compressor continues to compress the air upstream of the throttle valve due to its inertia so that air continues to be driven through the air flow meter at a considerable rate. During this period, however, air flow is substantially obstructed by the throttle valve. Thus, the sensed air flow rate becomes considerably greater than the rate of actual air flow at the fuel injection valves downstream of the throttle valve. This greater apparent air flow rate results in an excessively high rate of fuel injection, since the rate of fuel injection is proportional to the sensed air flow rate.

SUMMARY OF THE INVENTION

It is an object of this invention to provide a fuel supply control system for an internal combustion engine which maintains the air-to-fuel ratio of the mixture entering the engine at acceptable levels when the engine throttle valve is closed.

In accordance with this invention, a fuel supply control system is applied to an internal combustion engine having a combustion chamber, an air passage leading to the combustion chamber for conducting air to the combustion chamber, a throttle valve disposed in the air passage for adjusting the rate of air flow into the combustion chamber, and a compressor disposed in the air passage at a point upstream of the throttle valve for compressing the air. A flow meter is disposed in the air passage at a point upstream of the compressor for sensing the rate of air flow through the air passage. Fuel is injected into the air passage at a point downstream of the throttle valve. The rate of fuel injection normally has a preset relationship with the sensed air flow rate. When the throttle valve is closed, the fuel injection rate is limited to no more than a predetermined level regardless of the preset relationship between the fuel injection rate and the sensed air flow rate.

In the case of periodic fuel injection at a frequency proportional to engine speed, the amount of fuel injected during each fuel injection stroke may be limited to a predetermined level when the throttle valve is closed.

BRIEF DESCRIPTION OF THE DRAWINGS

Like and corresponding elements are denoted by the same reference numerals throughout the drawings.

DESCRIPTION OF THE PREFERRED EMBODIMENTS

Figure 1:
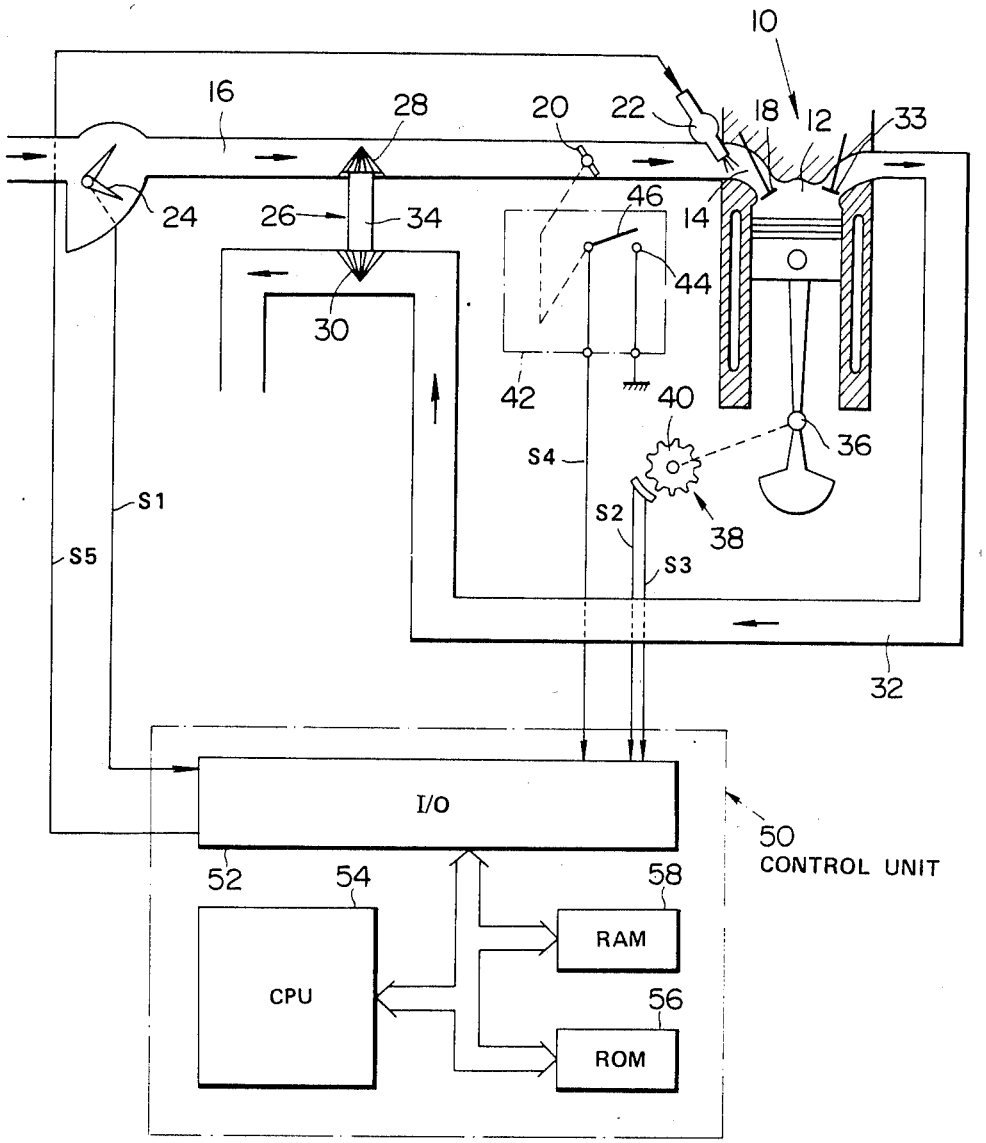
FIG. 1 is a diagram of a fuel control system for an internal combustion engine according to a first embodiment of this invention.

With reference to FIG. 1, an internal combustion engine 10 has combustion chambers 12 and air intake ports 14. Only one set of the combustion chamber 12 and the air port 14 is shown in FIG. 1. One end of each intake port 14 is connected to common air intake passage 16. The other end of each intake port 14 opens into the corresponding combustion chamber 12 via an inlet valve 18. Air passes through the intake passage 16 before entering the combustion chambers 12 via the intake ports 14. A throttle valve 20 disposed in the intake passage 16 controls the rate of air flow into the combustion chambers 12.

Fuel injection valves 22 project into the intake ports 14 respectively to inject fuel into them. In this way, fuel injection is performed downstream of the throttle valve 20. An air flow meter 24 disposed in the intake passage 16 at a point upstream of the throttle valve 20 monitors the rate of air flow into the combustion chambers 12. As is described in more detail hereafter, under most engine operating conditions except the start of deceleration, the rate of fuel injection is controlled basically in proportion to the monitored rate of air flow in order to hold the air-to-fuel ratio of the mixture entering the combustion chambers 12 at a given optimal level. The air flow meter 24 generates a signal S1 indicative of the monitored rate of air flow.

A turbocharger 26 includes a compressor 28 and a turbine 30. The compressor 28 disposed in the intake passage 16 at a point upstream of the throttle valve 20 but downstream of the air flow meter 24 compresses the air into the combustion chambers 12 in order to boost the engine power output. The turbine 30 is disposed in an exhaust passage 32 extending from the combustion chambers 12 via outlet valves 33. As exhaust gases emitted from the combustion chambers 12 travel through the exhaust passage 32, they drive the turbine 30. The compressor 28 and the turbine 30 are connected via a shaft 34 so that rotation of the turbine 30 drives the compressor 28.

One end of an idle air passage (not shown) is connected to the intake passage 16 at a point upstream of the throttle valve 20 but downstream of the compressor 28. The other end of this idle passage is connected also to the intake passage 16 at a point downstream of the throttle valve 20. In this way, the idle passage bypasses the throttle valve 20. When the throttle valve 20 is closed to idle the engine 10, air flows into the combustion chambers 12 via the idle passage. During engine idling operation, the rate of air flow into the combustion chambers 12 depends on the effective crosssectional area of the idle passage. This effective cross-sectional area of the idle passage is considerably smaller than the smallest cross-sectional area of the intake passage 16.

The engine 10 has a crankshaft 36 with which a crank angle sensor 38 is associated. The crank angle sensor 38 includes a toothed disc 40 and two magnetic pickups. The toothed disc 40 is mounted on the crankshaft 36 so that it rotates synchronously with the crankshaft 36. The magnetic pickups are fixed near the toothed disc 40. An alternating voltage induced across the first magnetic pickup represents angular units of crankshaft rotation. An alternating voltage induced across the second magnetic pickup represents preset reference angular positions of the crankshaft. Waveshaping circuits convert these alternating voltages to corresponding pulse signals S2 and S3 referred to hereafter as the unit crank angle signal and the reference crank angle signal respectively.

A throttle valve position sensor or throttle valve switch 42 is associated with the throttle valve 20 to sense whether or not the throttle valve 20 is in its closed position. The throttle switch 42 generates a signal S4 representing whether or not the throttle valve 20 has assumed its closed position. Specifically, the throttle switch 42 includes a fixed contact 44 and a movable contact 46. When the throttle valve 20 is closed, the movable contact 46 comes into contact with the fixed contact 44 so that the signal S4 assumes the "ON" state. When the throttle valve 20 is opened, i.e., moved out of its closed position, the movable contact 46 separates from the fixed contact 44 so that the signal S4 assumes the "OFF" state.

A control unit or digital microcomputer unit 50 includes an input/output (I/O) circuit 52, a central processing unit (CPU) 54, a read-only memory (ROM) 56, and a random-access memory (RAM) 58 which are connected to each other.

The I/O circuit 52 is connected to the air flow meter 24 to receive the signal S1. Since the air flow rate signal S1 is analog, the I/O circuit 52 includes an analog-to-digital converter which transforms the signal S1 into a corresponding digital signal.

The I/O circuit 52 is connected to the crank angle sensor 38 to receive the signals S2 and S3. The frequency of the unit crank angle signal S2 is proportional to the rotational speed of the crankshaft 36, that is, the engine speed. The I/O circuit 52 includes a frequency detector which monitors the frequency of the unit crank angle signal S2 in order to determine the engine speed. This frequency detector outputs a digital signal representing the engine speed.

The I/O circuit 52 is connected to the fuel injection valves 22 to output a fuel injection pulse signal S5 to them. The fuel injection valves 22 are composed of electrically-driven or electromagnetic valves. While the fuel injection pulses S5 are being applied to the valves 22, these valves 22 remain open and inject fuel. In the absence of fuel injection pulses S5, the valves 22 remain closed and interupt fuel injection. The duration or width of fuel injection pulses S5 directly determines the intervals of time for which fuel injection is performed. As a result, the quantity of fuel injected during each fuel injection stroke is proportional to the duration of fuel injection pulse S5. Also, the rate of fuel injection depends on the duration of fuel injection pulses S5. Note that the speed of fuel flow through the injection valves 22 is maintained at a constant level by a pressure regulating device (not shown). As is described in more detail hereafter, the fuel injection pulses S5 are synchronous with the reference crank angle pulses S3 so that output of the fuel injection pulses S5 occurs at preset crank angles indicated by the reference pulses S3. The I/O circuit 52 includes switching power transistors which amplify the fuel injection pulses S5 to a preset level adequate to drive the fuel injection valves 22.

On the basis of the air flow rate signal S1, the crank angle signals S2 and S3, and the throttle valve position signal S4, the control unit 50 adjusts the fuel injection signal S5 in order to control the rate of fuel injection.

Figure 2:
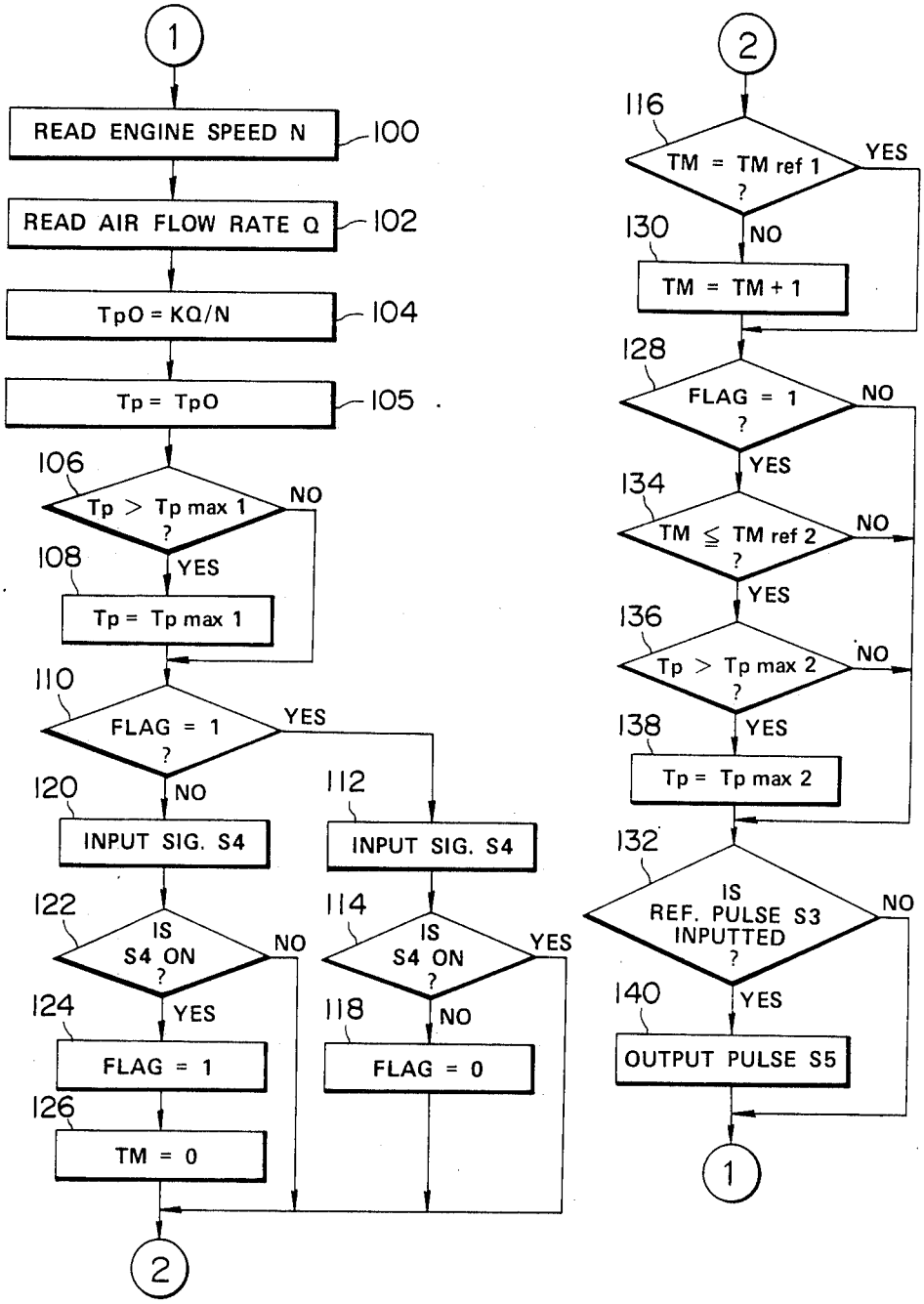
FIG. 2 is a flowchart of a program controlling operation of the control unit of FIG. 1.

The control unit 50 operates in accordance with a program stored in the ROM 56. FIG. 2 is a flowchart of this program. During first step 100 of this program, the control unit 50 reads or derives the current value of engine speed on the basis of the unit crank angle signal S2. In the program, a variable N represents the engine speed value. After step 100, the program advances to step 102 in which the control unit 50 reads or derives the current value of air flow rate on the basis of the air flow rate signal S1. In the program, a variable Q represents the air flow rate value. During step 104 subsequent to step 102, the control unit 50 calculates the desired basic value of duration or width of the fuel injection pulse S5 on the basis of the engine speed value N and the air flow rate value Q. In the program, a variable Tp0 represents the desired basic value of duration of the fuel injection pulse S5. Specifically, the desired basic duration value Tp0 is derived from the equation "Tp0=KQ/N", where K is a preset constant stored in the ROM 56. In step 105 subsequent to step 104, the control unit 50 sets a variable Tp to the basic value Tp0. This variable Tp will eventually represent the final desired value of the duration of the fuel injection pulse S5.

After step 105, the program advances to step 106 where the control unit 50 determines whether or not the desired duration of the injection pulse indicated by the current value of variable Tp is greater than a preset maximum duration value Tpmax1 stored in the ROM 56. When the value in the variable Tp is greater than the maximum value Tpmax1, the program advances from step 106 to step 108 in which the control unit 50 sets the variable Tp to the maximum value Tpmax1. As a result, the desired injection duration value in the variable Tp is limited to a maximum defined by the value Tpmax1. After step 108, the program proceeds to step 110. When the desired value Tp is not greater than the maximum value Tpmax1 in step 106, the program directly advances to step 110.

In step 110, the control unit 50 determines whether or not a variable FLAG equals one. As will be clear hereafter, the variable FLAG represents whether or not the throttle valve 20 is closed. When the variable FLAG equals one, the program advances from step 110 to step 112 in which the control unit 50 receives the throttle valve position signal S4. In step 114 subsequent to step 112, the control unit 50 determines whether or not the throttle valve position signal S4 is in the "ON" state. When the signal S4 is in the "ON" state, that is, when the throttle valve 20 is closed, the program proceeds from step 114 to step 116. When the signal S4 is not in the "ON" state, that is, when the throttle valve 20 is open, the program proceeds from step 114 to step 118 in which the control unit 50 sets the variable FLAG to zero. The variable FLAG is set to zero to indicate that the throttle valve 20 is open. After step 118, the program advances to step 116.

If the variable FLAG is not equal to one in step 110, the program advances from step 110 to step 120 in which the control unit 50 receives the throttle valve position signal S4. In step 122 subsequent to step 120, the control unit 50 determines whether or not the throttle valve position signal S4 is in the "ON" state. When the signal S4 is not in the "ON" state, that is, when the throttle valve 20 is open, the program advances directly from step 122 to step 116. When the signal S4 is in the "ON" state, that is, when the throttle valve 20 is closed, the program advances from step 122 to step 124 in which the control unit 50 sets the variable FLAG to one. The variable FLAG is set to one to indicate that the throttle valve 20 is closed. In step 126 subsequent to step 124, the control unit 50 sets a variable TM to zero. As will be explained hereafter, the variable TM represents elapsed time from the moment of closing of the throttle valve 20. After step 126, the program advances to step 116.

In step 116, the control unit 50 determines whether or not the variable TM equals a first preset reference value TMref1, preferably 255, stored in the ROM 56. If the variable TM equals the reference value TMref1, the program advances from step 116 to step 128. If the variable TM is not equal to the reference value TMref1, the program advances from step 116 to step 130 in which the control unit 50 increments the variable TM by one, i.e., the statement "TM=TM+1" is executed. After step 130, the program proceeds to step 128.

In step 128, the control unit 50 determines whether or not the variable FLAG is equal to one. If the variable FLAG is not equal to one, the program proceeds from step 128 to step 132. If the variable FLAG is equal to one, the program proceeds from step 128 to step 134.

In step 134, the control unit 50 determines whether or not the variable TM exceeds a second preset reference value TMref2, preferably 130, stored in the ROM 56. This second value TMref2 is chosen to be smaller than the first value TMref1. If the variable TM exceeds the reference value TMref2, the program advances from step 134 to step 132. If the variable TM is equal to or smaller than the reference value TMref2, the program advances from step 134 to step 136.

In step 136, the control unit 50 determines whether or not the desired duration value of the injection pulse in the variable Tp exceeds another preset maximum duration value Tpmax2 stored in the ROM 56. Preferably, this value Tpmax2 is considerably smaller than the value Tpmax1 in step 106. If the desired value in the variable Tp does not exceed the maximum value Tpmax2, the program advances from step 136 to step 132. If the desired value in the variable Tp exceeds the maximum value Tpmax2, the program advances from step 136 to step 138 in which the control unit 50 resets the variable Tp to the maximum value Tpmax2. After step 138, the program proceeds to step 132.

In step 132, the control unit 50 determines whether or not a reference crank angle pulse S3 has just been received. If a reference crank angle pulse S3 has just been inputted, the program advances from step 132 to step 140 which enables the control unit 50 to output a fuel injection pulse S5 having a duration corresponding to the desired value in the variable Tp. In this way, fuel injection pulses S5 are periodically outputted to the fuel injection valves 22 at reference crank angles defined by the signal S3. Thus, fuel injection is performed periodically at these reference crank angles. The frequency of the occurrences of fuel injections is, therefore, proportional to the engine speed. The quantity of fuel injected during each fuel injection stroke is proportional to the value of the variable Tp. After step 140, the program returns to initial step 100. If a reference crank angle pulse S3 has not just been received, the program returns from step 132 to initial step 100.

As a result of return to initial step 100, the program is repeated periodically. This period is chosen to be a fixed value, preferably 10 milliseconds.

While the throttle valve 20 remains open, the program generally continues to advance from step 110 to step 116 by way of steps 120 and 122 only and the variable FLAG remains zero. In the first execution cycle after the throttle valve 20 closes, the variable FLAG is still zero and the throttle valve position signal S4 changes to the "ON" state so that the program advances from step 110 to step 116 by way of steps 120, 122, 124, and 126. As a result of execution of step 124, the variable FLAG is set to one. Execution of step 126 sets the variable TM to zero.

While the throttle valve 20 remains closed, the program advances from step 110 to step 116 by way of steps 112 and 114 only. In the first cycle of execution after the throttle valve 20 opens again, the variable FLAG is still one and the throttle valve position signal S4 changes to the "OFF" state so that the program advances from step 110 to step 116 by way of steps 112, 114, and 118. Execution of step 118 sets the variable FLAG to zero.

Accordingly, the variable FLAG indicates whether or not the throttle valve 20 is closed. Specifically, the variable FLAG is set to zero to indicate that the throttle valve 20 is open, whereas it is set to one to indicate that the throttle valve 20 is closed.

As described previously, as soon as the throttle valve 20 is closed, the variable TM is set to zero in step 126. As long as the throttle valve 20 remains closed, the program continues to advance from step 116 to step 128 by way of step 130 until the variable TM reaches the first reference value TMref1, preferably 255. Execution of step 130 increments the variable TM by one. When the variable TM reaches the reference value TMref1, the program advances directly from step 116 to step 128. As a result, the variable TM is limited to a maximum value equal to the reference value TMref1. After the throttle valve 20 is closed, the variable TM is incremented one by one from zero to the maximum value TMref1. Since the period of repetition of the program is constant, the variable TM represents elapsed time from the moment of closing of the throttle valve 20.

As long as the throttle valve 20 remains closed, the variable FLAG will be equal to one, and so the program will continue to advance from step 128 to step 134. In this case, until the variable TM exceeds the second reference value TMref2, preferably 130, the program will continue to advance from step 134 to step 136. In step 136, the desired injection duration value in the variable Tp derived in step 104 or step 108 is compared to the preset value Tpmax2. If the desired value of the variable Tp exceeds the preset value Tpmax2, the program advances from step 136 to step 138 in which the variable Tp is reset to the preset value Tpmax2. If the desired value in the variable Tp does not exceed the preset value Tpmax2, the program advances directly from step 136 to step 132. In this way, steps 136 and 138 cooperate to set the variable Tp to the smallest of the value Tp0 calculated by step 104, the preset value Tpmax1 used in step 108, and the preset value Tpmax2 used in step 138. Since the preset value Tpmax2 is smaller than the present value Tpmax1, the smaller of the value Tp0 calculated by step 104 and the preset value Tpmax2 is selected and loaded into the variable Tp.

As a result, as long as the throttle valve 20 remains closed and the time elapsed since the closing of the throttle valve 20 does not exceed a preset value defined by the second reference value TMref2, the durations of the fuel injection pulses S5 are limited to a maximum equal to the preset value Tpmax2. Accordingly, in this case, the quantity of fuel injected during each fuel injection stroke is limited to no more than a preset level defined by the value Tpmax2. This value Tpmax2 is chosen so as to prevent excessive enrichment of the airfuel mixture which might otherwise be caused by the inertia of the compressor 28 under such conditions. In other cases, e.g., when the throttle valve 20 is closed and the elapsed time from the closing of the throttle valve 20 exceeds the preset value, or while the throttle valve 20 remains open, the durations of the fuel injection pulses S5 equal the smaller of the value Tp0 calculated by step 104 and the preset value Tpmax1. In these cases, when the value Tp0 is used for the fuel injection pulse S5, the rate of fuel injection is proportional to the sensed rate of air flow. This is because the frequency of the occurrences of fuel injections is proportional to the engine speed, while the quantity of fuel injected during each fuel injection stroke is proportional to the sensed air flow rate but is inversely proportional to the engine speed (see $Tp0=KQ/N$).

In the preferred case, since the period of repetition of the program is 10 milliseconds and the second preset value TMref2 is 130, the preset length of time after the closing of the throttle valve 20 defined by the second preset value TMref2 is 1300 milliseconds or 1.3 seconds. This preset length of time is designed to coincide with the interval of time during which excessive enrichment of the air-fuel mixture due to the inertia of the compressor 28 might generally last. Specifically, this preset length of time depends on the characteristics of the compressor 28 and the engine 10.

Figure 3:
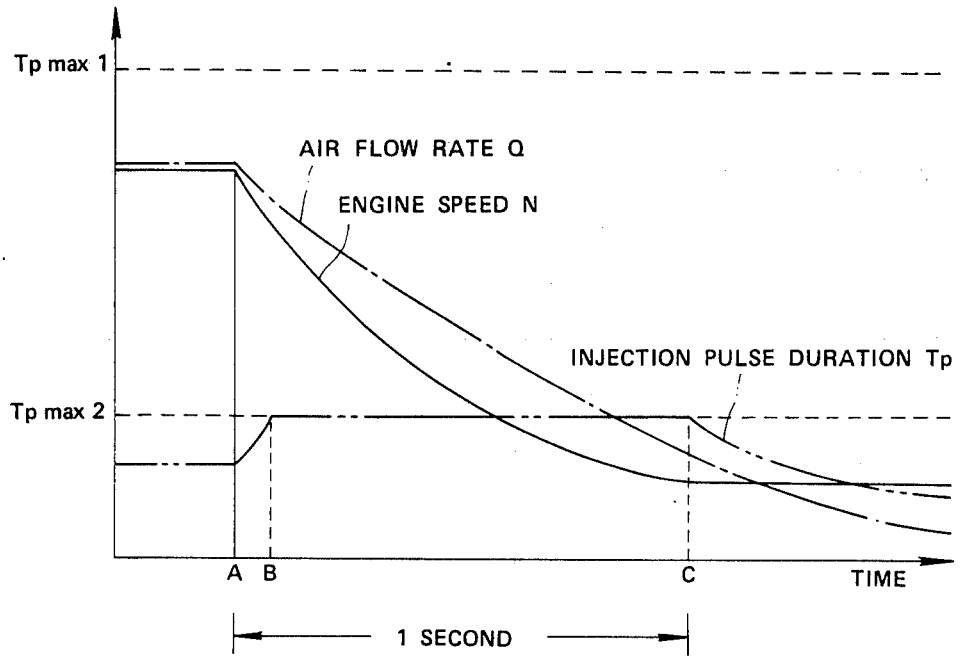
FIG. 3 is a diagram of the behavior of the fuel injection pulse duration Tp, the air flow rate Q, and the engine speed N when the throttle valve is closed.

FIG. 3 illustrates the behavior of the variable Tp representing the duration of the fuel injection pulses S5 under typical conditions in which the throttle valve 20 is closed at time A in order to decelerate the engine 10. Immediately after the closing of the throttle valve 20, the compressor 28 continues to run at considerable power levels due to its inertia so that the air flow rate Q decreases more slowly than the engine speed N does. As a result, the basic desired injection duration value Tp0 calculated in step 104 increases and quickly exceeds the preset value Tpmax2 at time B. Between the points A and B, the value of the variable Tp equals the basic desired value Tp0 calculated in step 104. Thereafter, the engine speed N substantially ceases to decrease and converges to a preset idle level but the air flow rate Q continues to decrease. As a result, the basic desired injection duration value Tp0 calculated in step 104 drops and then reaches the preset value Tpmax2 at time C. Between the points B and C, the value of the variable Tp remains equal to the preset value Tpmax2. After the point C, the basic desired injection duration value Tp0 calculated in step 104 drops below the preset value Tpmax2 so that the value of the variable Tp equals the calculated value Tp0.

Figure 4:
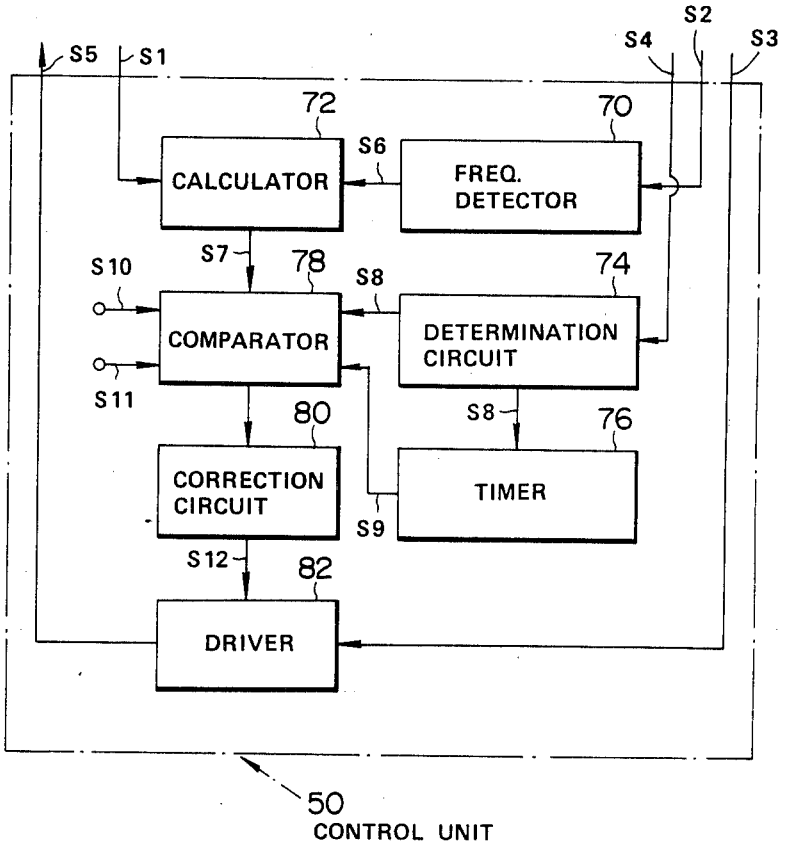
FIG. 4 is a block diagram of a control unit used in place of the control unit of FIG. 1.

FIG. 4 shows another example of the control unit 50. This control unit 50 includes a frequency detector 70 which is connected to the crank angle sensor 38 (see FIG. 1) to receive the unit crank angle signal S2. The frequency detector 70 monitors the frequency of the unit crank angle signal S2 and outputs a signal S6 indicating the engine speed. Note that the frequency of the unit crank angle signal S2 is proportional to the engine speed.

A calculator 72 is connected to the air flow meter 24 (see FIG. 1) to receive the air flow rate signal S1. The calculator 72 is also connected to the frequency detector 70 to receive the engine speed signal S6. The calculator 72 derives the basic desired injection duration value Tp0 on the basis of the air flow rate value Q and the engine speed value N derived from the signals S1 and S6. Specifically, $Tp0=KQ/N$, where K is a preset constant. The calculator 72 outputs a signal S7 indicating the basic desired injection duration value Tp0.

A determination circuit 74 is connected to the throttle switch 42 (see FIG. 1) to receive the throttle valve position signal S4. On the basis of the throttle valve position signal S4, this circuit 74 determines whether or not the throttle valve 20 (see FIG. 1) is closed. The determination circuit 74 outputs a signal S8 indicating whether or not the throttle valve is closed. In this way, the determination circuit 74 converts the throttle valve position signal S4 to the signal S8.

A timer 76 including a counter is connected to the determination circuit 74 to receive the throttle condition signal S8. The timer 76 measures elapsed time from the point at which the throttle valve 20 is closed. Specifically, when the throttle valve 20 is closed, the counter is reset by the throttle condition signal S8 to an initial state in which the counter reads zero. Thereafter, the number in the counter is incremented by one periodically, preferably every 10 milliseconds. The timer 76 outputs a signal S9 indicating the contents of the counter, that is, the elapsed time since the closing of the throttle valve 20.

A comparator 78 is connected to the calculator 72, the determination circuit 74, and the timer 76 to receive the basic injection duration signal S7, the throttle condition signal S8, and the time signal S9. While the throttle valve 20 remains closed and the time elapsed from the closing of the throttle valve 20 remains within a preset value, preferably 1.3 seconds, the comparator 78 compares the basic injection duration value Tp0 with a preset maximum duration value Tpmax2 represented by a reference signal S11 applied to the comparator 78. In this case, the comparator 78 selects one of the signals S7 and S11 depending on which of the values Tp0 and Tpmax2 is smaller. In other cases, the comparator 78 compares the basic injection duration value Tp0 with another preset maximum duration value Tpmax1 represented by a reference signal S10 applied to the comparator 78. In these cases, the comparator 78 selects one of the signals S7 and S10 depending on which of the values Tp0 and Tpmax1 is smaller.

A correction circuit 80 is connected to the comparator 78 to receive the signal selected by the comparator 78. The correction circuit 80 modifies the selected signal on the basis of engine operating conditions. Specifically, the correction circuit 80 outputs a pulse signal S12 representing a modified injection duration value $Ti=Tp(Cw+Ct+Co2)$, where Tp is the value corresponding to the selected signal, Cw is a correction coefficient dependent on the temperature of engine coolant, Ct is a correction coefficient dependent on the ambient air temperature, and Co2 is a correction coefficient dependent on the monitored airto-fuel ratio as indicated by a signal from an oxygen sensor (not shown) detecting the oxygen concentration in engine exhaust.

A driver circuit 82 is connected to the crank angle sensor 38 (see FIG. 1) to receive the reference crank angle signal S3. The driver 82 is also connected to the correction circuit 80 to receive the pulse signal S12 indicating the modified injection duration value Ti. On the basis of these signals S3 and S12, the driver 82 outputs the fuel injection pulse signal S5. The fuel injection valves 22 are connected to the driver 82 to receive the fuel injection pulse signal S5.

The driver 82 includes power transistors. When enabled by reference crank angle pulses S3, the power transistors are turned on to output fuel injection pulses S5 whose durations correspond to the value indicated by the signal S12.

Figure 5:
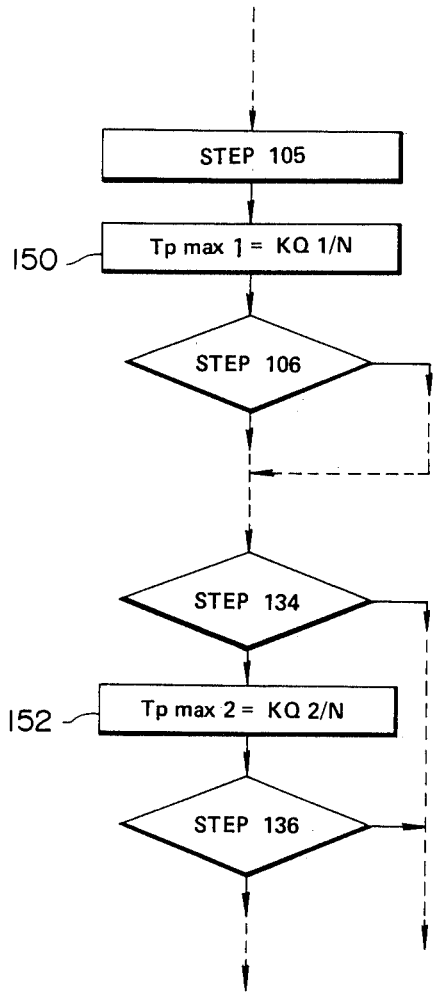
FIG. 5 is a modified flowchart used in place of the flowchart of FIG. 2.

FIG. 5 is a modification of the flowchart of FIG. 2. In this modified flowchart, new step 150 is provided between steps 105 and 106, and a second new step 152 is provided between steps 134 and 136.

In step 150, the control unit 50 (see FIG. 1) sets a variable Tpmax1 equal to KQ1/N, where K is the same constant as in step 104 (see FIG. 2), Q1 is a preset constant stored in the ROM 56 (see FIG. 1), and N is the engine speed value derived in step 100 (see FIG. 2). In step 106 subsequent to step 150, the control unit 50 determines whether or not the value of the variable Tp exceeds the value of the variable Tpmax1 derived in step 150. As a result of step 150, the rate of fuel injection is limited to a level determined by the constants K and Q1.

In step 152, the control unit 50 sets a variable Tpmax2 equal to KQ2/N, where K is the same constant as in step 104, Q2 is a preset constant stored in the ROM 56, and N is the engine speed value derived in step 100. The constant Q2 is considerably smaller than the constant Q1. In step 136 subsequent to step 152, the control unit 50 determines whether or not the value of the variable Tp exceeds the value of the variable Tpmax2 given in step 152. As a result of step 152, the rate of fuel injection is limited to a level determined by the constants K and Q2 when the throttle valve 20 is closed. This limit value is chosen so as to prevent excessive enrichment of the air-fuel mixture which might otherwise be caused by inertia of the compressor 28 (see FIG. 1) under such conditions.

Figure 6:
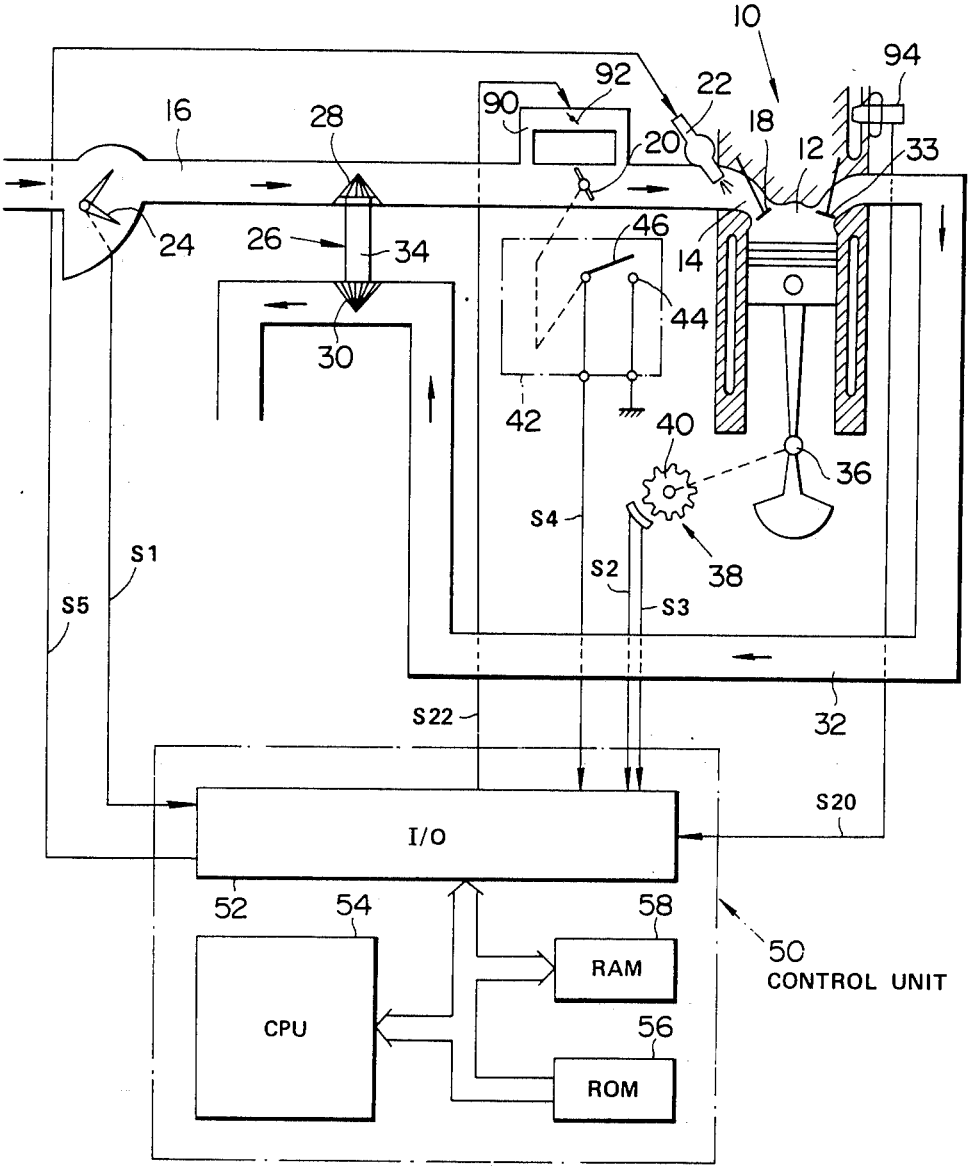
FIG. 6 is a diagram of a fuel control system for an internal combustion engine according to a second embodiment of this invention.

FIG. 6 shows a second embodiment of this invention which is similar to the embodiment of FIG. 1 except for design changes described below.

In the embodiment of FIG. 6, an auxiliary air passage 90 is connected to the air intake passage 16 in such a manner as to bypass the throttle valve 20. An air regulating valve 92 is disposed in the auxiliary passage 90 to adjust the rate of air flow through the passage 90. This valve 92 is controllable by an electrical signal S22.

A temperature sensor 94 is installed in the body of the engine 10 to sense the temperature of engine coolant. This sensor 94 outputs a signal S20 representing the coolant temperature.

The I/O circuit 52 is connected to the sensor 94 to receive the coolant temperature signal S20. Since the temperature signal S20 is analog, the I/O circuit 52 includes an analog-to-digital converter which converts the temperature signal S20 into a corresponding digital signal.

On the basis of the temperature signal S20, the control unit 50 generates the signal S22 designed to control the air valve 92. The I/O circuit 52 is connected to the air valve 92 to supply the signal S22 to the air valve 92. On the basis of the temperature signal S20, the control unit 50 adjusts the fuel injection signal S5.

Figure 7:
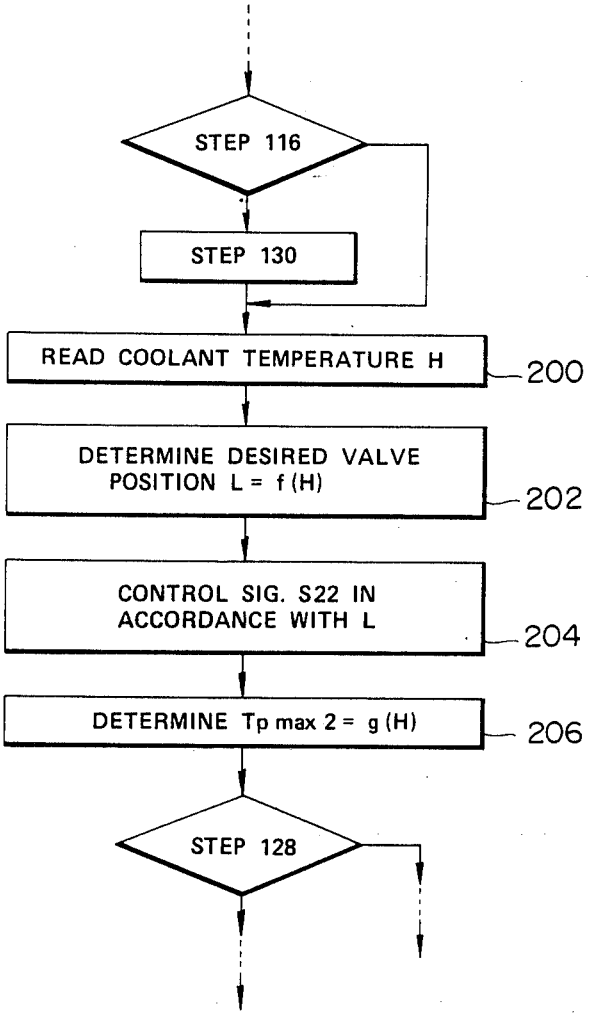
FIG. 7 is a flowchart of a program controlling operation of the control unit of FIG. 6.

FIG. 7 is a flowchart of a program controlling operation of the control unit 50 of FIG. 6. This program includes a series of steps 200, 202, 204, and 206 disposed in the loop shown in FIG. 2. Specifically, this series of steps 200, 202, 204, and 206 is executed between steps 116 and 128, or between steps 130 and 128.

After step 116 or step 130, the program executes step 200 in which the control unit 50 reads or derives the current value of engine coolant temperature on the basis of the temperature signal S20. In the program, a variable H represents the coolant temperature value.

In step 202 subsequent to step 200, the control unit 50 determines the desired value of the degree of opening of the air valve 92 in accordance with the coolant temperature value in the variable H derived in step 200. In the program, a variable L represents the desired valve opening value. Specifically, a table stored in the ROM 56 holds a set of desired valve opening values which are plotted as a known function of the coolant temperature values. By referring to this table, the control unit 50 determines the desired valve opening value on the basis of the coolant temperature value.

After step 202, the program advances to step 204 in which the control unit 50 adjusts the signal S22 in accordance with the desired valve opening value in the variable L in order to match the actual degree of opening of the air valve 92 to the desired value thereof determined in step 202.

In step 206 subsequent to step 204, the control unit 50 determines the maximum duration of the fuel injection pulses S5 in accordance with the coolant temperature value in the variable H derived by step 200. In the program, a variable Tpmax2 represents this maximum duration value. Specifically, another table stored in the ROM 56 holds a set of maximum injection pulse duration values which are plotted as a preset function of the coolant temperature values. By referring to this table, the control unit 50 determines the maximum duration value on the basis of the coolant temperature value. After step 206, the program advances to step 128.

In step 136, the control unit 50 determines whether or not the value in the variable Tp exceeds the value in the variable Tpmax2 given in step 206 as described previously with reference to FIG. 2.

As a result of steps 200, 202, and 204, the rate of air flow bypassing the throttle valve 20 depends on the engine coolant temperature. The relationship between the desired valve opening value and the coolant temperature value used in step 202 is so arranged that the rate of bypass air flow increases as the coolant temperature decreases. This is because warming up a cold engine requires rates of air flow into the engine higher than rates of air flow necessary for an adequately warmed-up engine.

As a result of steps 200, 206, 136, and 138 (see FIG. 2), the maximum durations of the fuel injection pulses S5 used when the throttle valve 20 is closed depend on the engine coolant temperature. The relationship between the maximum duration value and the coolant temperature value used in step 206 is so arranged that the corresponding maximum duration of the fuel injection pulses S5 increases with decreases in the coolant temperature in a manner similar to increases in the rate of bypass air flow with decreases in the coolant temperature.

In this way, the maximum amount of fuel injected during each fuel injection stroke when the throttle valve 20 is closed increases as the rate of bypass air flow increases.

Figure 8:
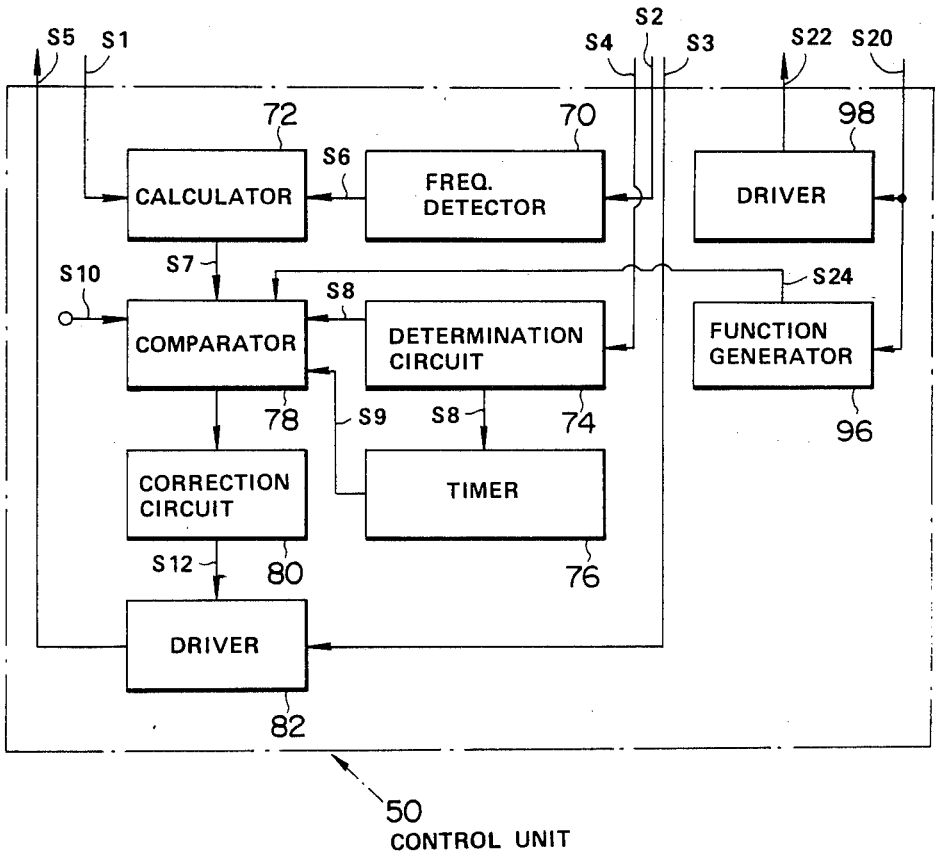
FIG. 8 is a block diagram of a control unit used in place of the control unit of FIG. 6.

FIG. 8 shows another example of the control unit 50 used in the embodiment of FIG. 6. The control unit 50 of FIG. 8 is similar to that of FIG. 4 except for design changes described below.

The control unit 50 of FIG. 8 includes a function generator 96 which is connected to the temperature sensor 94 (see FIG. 6) to receive the signal S20. The generator 96 outputs a signal S24 which varies as a preset function of the signal S20. This signal S24 represents a maximum duration value Tpmax2 which depends on the coolant temperature value indicated by the signal S20.

The comparator 78 is connected to the function generator 96 to receive the signal S24 in place of the signal S11 (see FIG. 6). The comparator 78 handles the signal S24 in a manner similar to the handling of the signal S11 described with reference to FIG. 4.

A driver 98 is connected to the temperature sensor 94 to receive the signal S20. This driver 98 outputs the signal S22 on the basis of the signal S20.

What is claimed is:

1. A fuel supply control system for an internal combustion engine having a combustion chamber, an air passage leading to the combustion chamber for conducting air to the combustion chamber, a throttle valve disposed in the air passage for adjusting the rate of air flow into the combustion chamber, and a compressor disposed in the air passage at a point upstream of the throttle valve for compressing the air, the system comprising:

(a) a flow meter disposed in the air passage at a point upstream of the compressor for sensing the rate of air flow through the air passage;

(b) first means, responsive to the flow meter, for injecting fuel into the air passage at a point downstream of the throttle valve at a rate having a preset relationship with the sensed air flow rate;

(c) second means for sensing whether or not the throttle valve is closed; and (d) third means, responsive to the second means, for limiting the fuel injection rate to no more than a predetermined level regardless of the preset relationship between the fuel injection rate and the sensed air flow rate when the throttle valve is closed.

2. The system of claim 1, further comprising fourth means responsive to the second means for measuring elapsed time since the moment of closing of the throttle valve, and fifth means responsive to the fourth means for determining whether or not the elapsed time exceeds a preset time value, the third means responsive to the fifth means and operable to maintain the limitation on the fuel injection rate as long as the elapsed time does not exceed the preset time value and the throttle valve remains closed.

3. A fuel supply control system for an internal combustion engine having a combustion chamber, an air passage leading to the combustion chamber for conducting air to the combustion chamber, a throttle valve disposed in the air passage for adjusting the rate of air flow into the combustion chamber, and a compressor disposed in the air passage at a point upstream of the throttle valve for compressing the air, the system comprising:

(a) a flow meter disposed in the air passage at a point upstream of the compressor for sensing the rate of air flow through the air passage and generating a signal indicative thereof;

(b) first means for sensing the rotational speed of the engine and generating a signal indicative thereof;

(c) second means, responsive to the air flow rate signal and the engine speed signal, for periodically injecting fuel into the air passage at a point downstream of the throttle valve at a frequency proportional to the engine speed, the amount of fuel injected during each fuel injection stroke having a preset relationship with the air flow rate and the engine speed;

(d) third means for sensing whether or not the throttle valve is closed and generating a signal indicative thereof; and (e) fourth means, responsive to the throttle valve signal, for limiting the amount of fuel injected during each fuel injection stroke to no more than a predetermined level regardless of the preset relationship of the fuel injection amount with the air flow rate and the engine speed when the throttle valve is closed.

4. The system of claim 3, further comprising fifth means responsive to the throttle valve signal for measuring elapsed time since the moment of closing of the throttle valve, and sixth means responsive to the fifth means for determining whether or not the elapsed time exceeds a preset time value, the fourth means responsive to the sixth means and operable to maintain the limitation on the fuel injection amount as long as the elapsed time does not exceed the preset time value and the throttle valve remains closed.

5. The system of claim 3, further comprising:

(a) a temperature sensor for sensing the temperature of coolant of the engine and generating a signal indicative thereof;

(b) an auxiliary passage connected to the air passage and bypassing the throttle valve;

(c) fifth means, responsive to the coolant temperature signal, for adjusting the rate of air flow through the auxiliary passage in accordance with the coolant temperature; and (d) sixth means, responsive to the coolant temperature signal, for adjusting the predetermined fuel injection level in accordance with the coolant temperature.

6. A method of controlling fuel supply to an internal combustion engine of the type having a supercharging compressor driving air down an intake duct to the engine, and a throttle valve downstream of the compressor, comprising the steps of:

(a) monitoring the position of the throttle valve;

(b) monitoring the rate of air flow through the intake duct at a point upstream of the compressor;

(c) deriving a desired fuel injection rate from the monitored air flow rate on the basis of a known relationship between the monitored air flow rate and the desired fuel injection rate;

(d) if the throttle valve is in a position blocking the intake duct to the greatest possible extent and the desired fuel injection rate exceeds a threshold value, replacing the derived desired fuel injection rate with the threshold value; and (e) injecting fuel into the intake duct downstream of the throttle valve at a rate corresponding to the desired fuel injection rate.

* * * * *